US006701540B1

(12) United States Patent
Gabriel

(10) Patent No.: US 6,701,540 B1
(45) Date of Patent: Mar. 9, 2004

(54) DISPOSABLE PLUNGER CONSTRUCTION

(76) Inventor: Christine F. Gabriel, 1111 Chase St., Bay City, MI (US) 48708

( * ) Notice: Subject to any disclaimer, the term of this patent is extended or adjusted under 35 U.S.C. 154(b) by 0 days.

(21) Appl. No.: 10/383,129

(22) Filed: Mar. 6, 2003

(51) Int. Cl.[7] ..... E03D 9/00
(52) U.S. Cl. ..... 4/255.11
(58) Field of Search ..... 4/255.01–255.12

(56) References Cited

U.S. PATENT DOCUMENTS

| | | | | |
|---|---|---|---|---|
| 952,495 A | * | 3/1910 | Austin | 248/205.8 |
| 1,852,071 A | | 4/1932 | Becker | |
| 3,423,781 A | | 1/1969 | Henson | |
| 4,169,687 A | | 10/1979 | Schull | |
| 4,247,216 A | | 1/1981 | Pansini | |
| 4,457,038 A | | 7/1984 | Hammond | |
| 5,092,013 A | | 3/1992 | Genovese | |
| 5,099,527 A | | 3/1992 | Roose | |
| 5,215,319 A | | 6/1993 | Farris | |
| 6,049,947 A | | 4/2000 | Lu | |
| 6,622,316 B1 | * | 9/2003 | Brown | 4/255.11 |

* cited by examiner

*Primary Examiner*—Charles E. Phillips
(74) *Attorney, Agent, or Firm*—John K. McCulloch

(57) ABSTRACT

A disposable plunger has a force cup and a handle removably coupled to the force cup. One end of a pliable, waterproof sleeve is sealed to the force cup and is coiled to form an annulus. Following coupling of the handle to the force cup the sleeve may be uncoiled so as to encircle a selected length of the handle. When the force cup and a portion of the handle are immersed in liquid, the sleeve prevents the liquid from contaminating the handle. When the need for the plunger has ended, the handle may be uncoupled from the force cup and the latter discarded together with the sleeve.

15 Claims, 2 Drawing Sheets

DISPOSABLE PLUNGER CONSTRUCTION

This invention relates to disposable plungers of the kind adapted for use in clearing clogged drains.

BACKGROUND OF THE INVENTION

Hand operated plungers long have been used for clearing household drains which become clogged. A typical plunger of this kind has a force cup formed of rubber or rubbery material which is coupled to one end of a handle of such length as to enable the user to place the cup in sealing relation to the drain following which the handle may be used to deform the cup and displace water within the cup forcibly into and through the drain in a direction to unclog the latter. The standing water above the drain can contain materials capable of contaminating the area adjacent the drain, the force cup, and that portion of the handle which may be immersed in the water.

Following the use of a plunger in an effort to unclog a drain it is believed to be fairly common for the handle and at least the upper portion of the force cup to be rinsed. However, cleaning of the inside of the force cup is more difficult because cleaning may require removal of the force cup from the handle or manipulating the cup to expose its inner surface to a cleansing stream. Placing the cup in such position may be impeded by the lack of sufficient space to enable the cup to be turned to the proper position, particularly if the handle remains attached. In either case handling of the cup and the handle after use of the plunger is unpleasant and can be quite messy.

Conventional plungers of the household kind have a threaded socket upstanding from the upper surface of the force cup and into which the correspondingly threaded end of a handle may be inserted. If it becomes necessary to separate the force cup from the handle before the components can be cleaned, the hands of the operator can become soiled.

Because of the difficulty in some instances and the unpleasantness associated with cleaning a plunger after use, the cleaning may in some instances be less than desirable as a consequence of which the parts of the plunger may be a source of contamination between periods of use.

An object of the invention is to provide a disposable plunger which enables the force cup to be discarded after each use and which protects the handle from contamination during use.

SUMMARY OF THE INVENTION

A plunger constructed in accordance with the preferred embodiment of the invention has a conventional force cup formed of flexible, resilient material having on its exterior an upstanding socket for the removable accommodation of one end of an elongate handle. Preferably, the handle and the socket have cooperable latching means for enabling and disabling rapid and easy separation of the handle from the force cup.

A pliable, waterproof, cylindrical sleeve has one end thereof sealed to the plunger socket on the outer surface thereof so that water cannot flow past the sealed end into the socket or the interior of the sleeve. The sleeve in its initial condition is coiled to form an annulus encircling the socket. Following the introduction of one end of the handle into the socket and latching the handle therein, the material forming the sleeve can be uncoiled so that the sleeve extends from the force cup in the direction of the handle and encloses or encircles at least the major portion thereof. It is contemplated that the sleeve will be of such length that, during the use of the plunger, the sleeve will extend to a level above that of the water that has collected above the clogged drain thereby ensuring that water will not enter the sleeve from its upper end.

Following use of the plunger the handle may be released from the force cup by a latch release actuator that preferably extends from the upper end of the handle downwardly through the latter so as to enable the handle to be released from the force cup without the operator's having to touch the latter. Once the force cup has been released from the handle the force cup, together with the sleeve, may be discarded.

The force cup and the sleeve should be formed of inexpensive materials so they may be disposed of readily. The material from which the sleeve is made should be pliable, waterproof, and easily uncoiled so as to encircle and protect the handle against contamination.

THE DRAWINGS

A disposable plunger constructed in accordance with the presently preferred embodiment of the invention is illustrated in the accompanying drawings wherein.

THE PREFERRED EMBODIMENT

Figure 1:
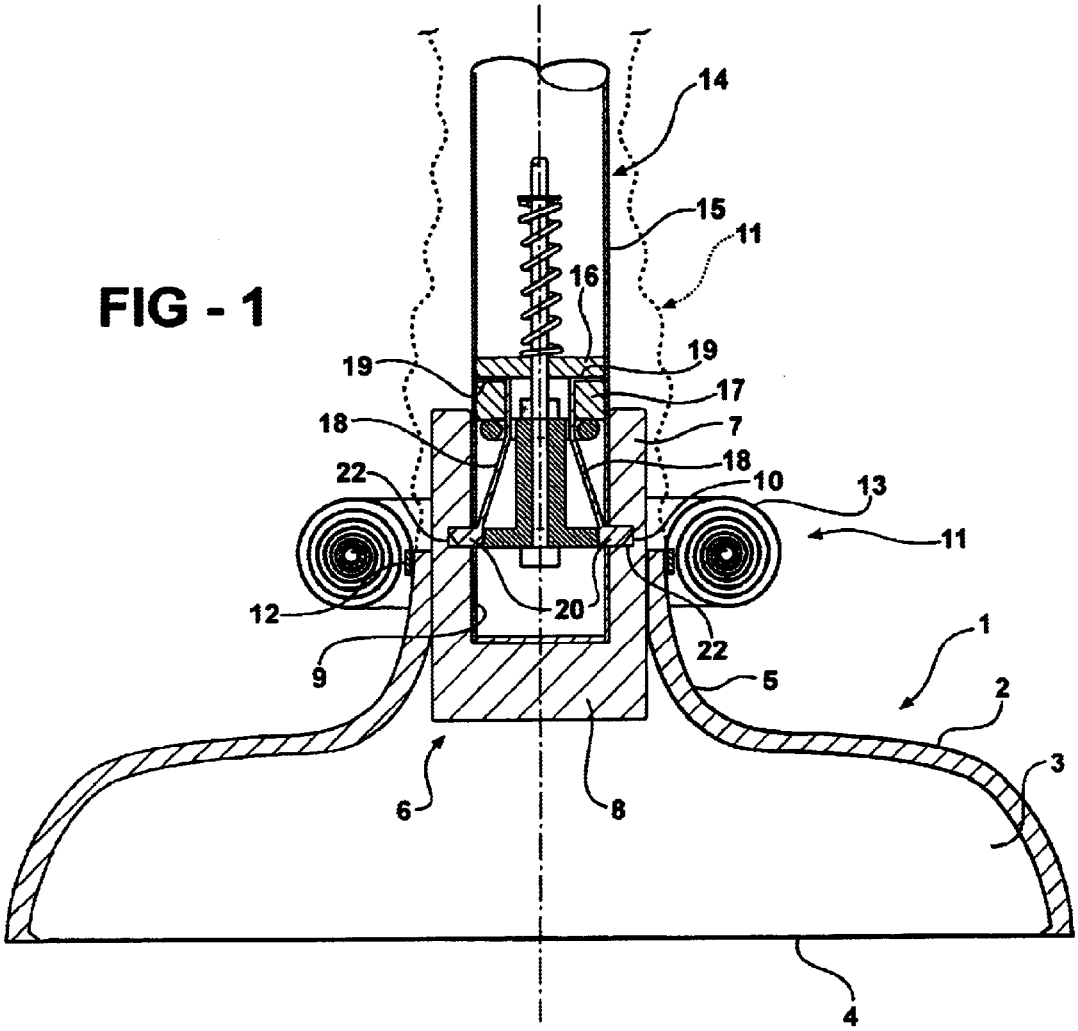
FIG. 1 is a fragmentary, vertical sectional view illustrating a force cup, a handle removably coupled to the force cup, and a coiled sleeve secured to the force cup in condition to be unrolled to the condition indicated in dotted lines.
Figure 4:
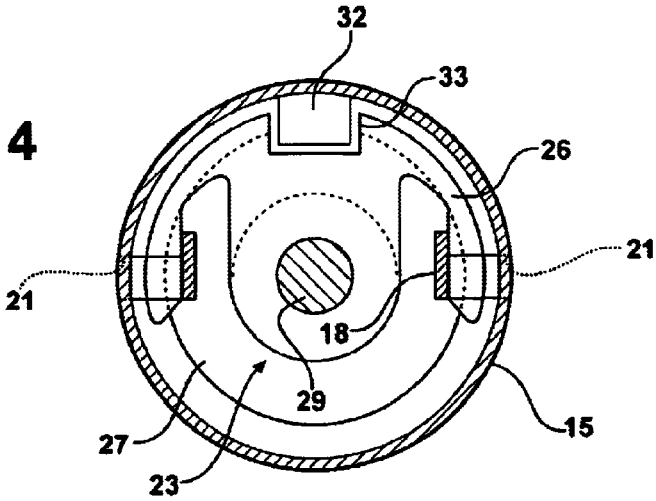
FIG. 4 is an enlarged, sectional view, taken on the line 4—4 of FIG. 2.

A disposable plunger constructed in accordance with the disclosed embodiment comprises a force cup 1 having a flexible, resilient wall 2 formed of rubber, rubbery, or other suitable material of the kind from which plunger force cups conventionally are formed. The wall 2 defines a chamber 3 having an open bottom 4 and an upstanding, centrally located boss 5. Accommodated within the boss 5 is a socket-forming member comprising a tubular socket 6 having an annular sidewall 7 and a flat bottom 8. The socket member 6 is permanently secured in sealed relation to the inner surface of the boss 5 by a suitable adhesive or in any other conventional, well-known manner. The socket member 6 has an axially extending, blind bore 9 open at its upper end. The bore is provided between its ends with an annular receiving groove 10 for a purpose presently to be explained.

Sealed to the exterior of the boss 5 and adjacent the upper edge thereof is one end of a cylindrical sleeve 11 formed of pliable, waterproof plastic or other suitable material of known kind. A reinforcing band 12 encircles the sealed end of the sleeve and is secured thereto in such manner as to guard against inadvertent separation of the sleeve from the boss. The sleeve is sealed to the upper end of the boss by a suitable, waterproof adhesive.

As shown in full lines in FIG. 1 the sleeve 11 is convolutedly coiled to form an annulus 13 which encircles the boss 5 and the socket member 6. In its annular form the coiled sleeve does not interfere with access to the open end of the bore 9.

A handle 14 is provided for removable assembly with the force cup 1 and comprises a preferably hollow, elongate tube 15 of such size as snugly to be accommodated in the bore 9. Adjacent that end of the handle which is adapted to be accommodated in the bore 9 is an anchor disc 16 that is fixed to the sidewall of the tube 15. Adjacent but spaced from the disc 16 is a ring 17 which also is fixed to the sidewall of the handle tube. Each one of a pair of arms 18 formed of springy metal or plastic has a flange 19 trapped between the disc 16 and the ring 17. Each of the arms 18 extends downwardly and terminates in a latching projection 20 which extends laterally of the tubular handle member 15. The tubular wall 15 is provided with openings 21 through which the projections 20 may extend, and the sidewall 7 of the socket member 6 is provided with an annular receiver groove 22 into which the projections 20 can be accommodated.

Actuating means 23 is provided for effecting extension and retraction of the latching projections 20 and comprises a spool-like body 24 having a central portion 25 terminating at its upper end in an arcuate retracting rim 26 and at its lower end in a disc 27. The rim 26 is positioned externally of the arms 18, whereas the disc 27 occupies a position below the projections 20. The body 24 has an axial bore 28 in which is fixed one end of an operating rod 29 which extends through the disc 16 to and somewhat beyond the upper end (not shown) of the handle 14. Fixed to the rod 29 is a disc 30 and between the discs 16 and 30 is a spring which normally urges the rod 29, and consequently the actuator body 24, in an upward direction. However, downward movement of the rod 29 manually enables both the rod and the actuator body 24 to be displaced downwardly from the position shown in FIG. 3 to the position shown in FIG. 2. The actuator body 24 is prevented from rotating within the handle and is guided in its movements by a guide rail 33 which is fixed to the tubular wall 15 and slideably accommodated in a vertically extending groove 33 formed in the body 24.

Figure 3:
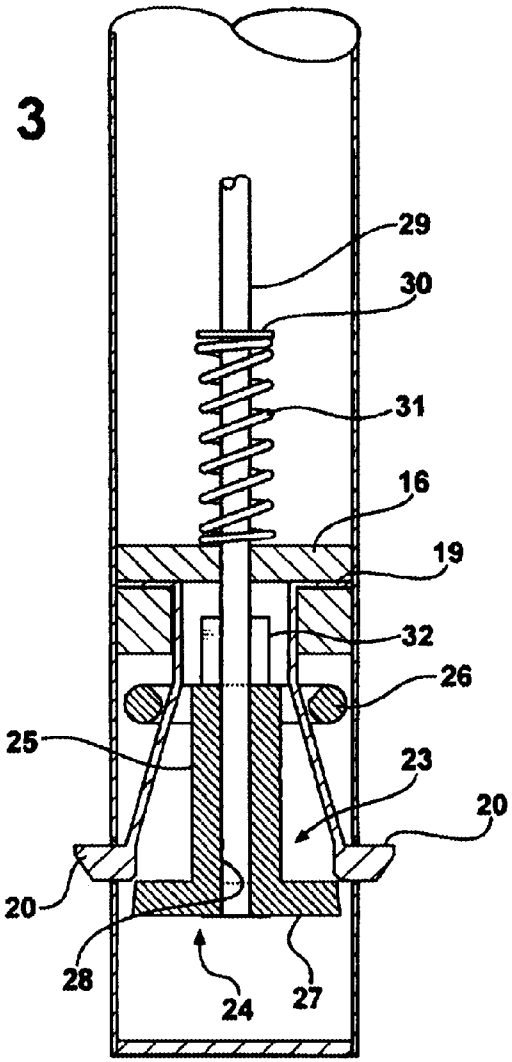
FIG. 3 is a view similar to FIG. 2, but showing the latching projections in extended positions.

When the actuator body 24 occupies its normal position as determined by the reaction between the spring 31 and the operating rod 29, the projections 20 will be in their extended positions and the disc 27 will be at a level below that of the latching projections 20, as is shown in FIG. 3. When the operating rod 29 is depressed, however, the actuator 24 will move downwardly and the retracting rim 26 will bear against the spring arms 18 and cause them to move or retract radially inwardly so as to withdraw the latching projections 20 through the openings 21 and into the interior of the handle 14. See FIG. 2.

Figure 2:
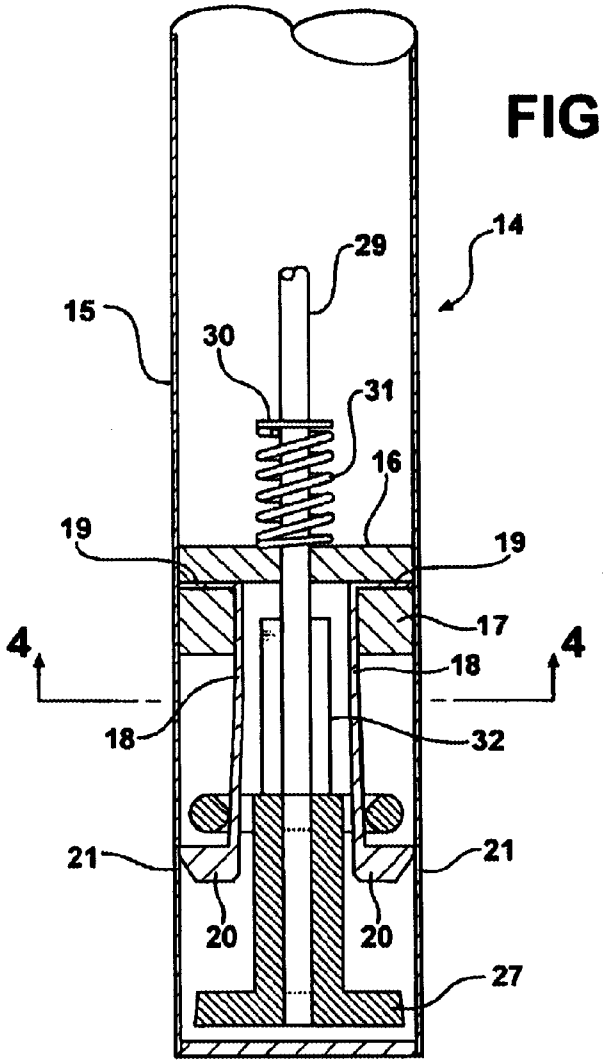
FIG. 2 is a fragmentary, vertical sectional view of a portion of the handle showing the latching projections in retracted positions.

To condition the plunger for use, and assuming the handle 14 is not attached to the force cup 1 and that the sleeve is in the annular, coiled condition, the operating rod 29 is depressed so as to position the latching projections 20 within the tubular handle as is shown in FIG. 2. That end of the handle containing the actuator body 24 then may be introduced into the bore 9 of the socket member 6 and moved downwardly. During this movement the rod 29 may be released whereupon the spring 31 may move the rod 29 upwardly, thereby enabling the spring arms 18 to extend the projections 20 through the openings 21 and into the receiver groove 22 in the socket member 6. The handle then will be coupled to the force cup.

Following coupling of the handle to the force cup the sleeve 11 may be uncoiled and moved upwardly as is indicated in dash lines in FIG. 1 so as to form a protective sheath encircling the handle for as great a distance as is desired.

Following uncoiling and extension of the sleeve the plunger may be operated in the conventional manner by placing the force cup over a clogged drain. If the drain is at the bottom of a sink or the like and if the sink contains a quantity of water, the force cup and the lower end of the handle may be submerged. However, the seal between the lower end of the sleeve 11 and the force cup will prevent any water from entering the bore 9 and contaminating the handle. At the same time, and since the sleeve encircles a desired length of the handle and is formed of waterproof material, no part of the handle which may be submerged will be contaminated by the contents of the sink.

When use of the plunger no longer is required, it may be removed from the clogged drain area and placed in a position overlying a refuse container whereupon the operating rod 29 may be depressed to move the actuator 23 to the position shown in FIG. 2. The latching projections 20 will be retracted, thereby enabling the handle to be uncoupled from the force cup. The sleeve still will be attached to the force cup and the sleeve may be discharged to the refuse container for disposal. The uncontaminated handle then may be stored for future use.

It may be desirable in some instances to form the sleeve of a known elastic, waterproof material, thereby enabling the sleeve, following use of the plunger, to be pulled over the force cup so as to stretch the sleeve laterally and enable the force cup 1 to be retained wholly within the sleeve.

The disclosed embodiment is representative of a presently preferred form of the invention, but is intended to be illustrative rather than definitive thereof. The invention is defined by the claims.

I claim:

1. A plunger construction comprising a force cup; a handle; means for removably coupling said handle to said cup; and a protective sleeve sealed at one end thereof to said cup, said sleeve being sealed to said cup in a position to encircle said handle when said handle is coupled to said cup.

2. The construction according to claim 1 wherein said sleeve is formed of waterproof, pliable material.

3. The construction according to claim 1 wherein said sleeve is formed of pliable material and is supported on said cup in the form of a convolutely coiled annulus.

4. The construction according to claim 3 wherein said sleeve is of such length that when uncoiled from said annulus it may extend a substantial distance from said cup.

5. The construction according to claim 1 wherein said means for removably coupling said handle to said cup comprises a socket for the removable accommodation of one end of said handle.

6. The construction according to claim 5 including releasable latch means carried by said one end of said handle and said socket for releasably latching said one end of said handle within said socket.

7. The construction according to claim 6 wherein said releasable latch means comprises at least one projection on said handle extending laterally and a receiver on said socket for receiving said projection.

8. The construction according to claim 7 wherein said receiver comprises a recess formed in said socket.

9. The construction according to claim 8 wherein said recess comprises an annular groove.

10. A plunger construction comprising a force cup having at one end thereof an upstanding socket for the removable accommodation of one end of an elongate handle; and a sleeve formed of pliable, waterproof material, said sleeve being sealed at one end thereof to said socket and being coiled to form an annulus encircling said socket, said sleeve being uncoilable from said annulus to enable said sleeve to extend substantially in cylindrical form from said one end to form a protective sheath in which said handle is accommodated.

11. The construction according to claim 10 including an elongate handle having one end accommodated in said socket, and separable coupling means carried by said handle and said socket for removably connecting said handle to said socket.

12. The construction according to claim 11 wherein said coupling means comprises projections carried by said handle and operable to extend laterally therefrom, and receiver means carried by said socket for accommodating said projections.

13. The construction according to claim 12 wherein said receiver means comprises a groove in said socket and wherein said projections are movable into and out of said groove.

14. The construction according to claim 13 including spring means exerting a biasing force on said projections toward said groove.

15. The construction according to claim 14 including retractor means engageable with said spring means for overcoming said biasing force and withdrawing said projections from said groove.

* * * * *